US005794332A

United States Patent [19]

Yamamoto et al.

[11] Patent Number: 5,794,332

[45] Date of Patent: Aug. 18, 1998

[54] METHOD OF PRODUCING A PLURALITY OF PRESS-CONNECTING JOINT CONNECTORS

[75] Inventors: Hiroshi Yamamoto; Akira Kato, both of Shizuoka, Japan

[73] Assignee: Yazaki Corporation, Tokyo, Japan

[21] Appl. No.: 597,151

[22] Filed: Feb. 6, 1996

[30] Foreign Application Priority Data

Feb. 9, 1995 [JP] Japan ..... 7-021773
Mar. 9, 1995 [JP] Japan ..... 7-049957

[51] Int. Cl.[6] ..... H01R 43/04

[52] U.S. Cl. ..... 29/863; 29/749; 29/857; 439/398; 439/937

[58] Field of Search ..... 29/863, 740, 857, 29/753, 845, 749, 423; 439/937, 398

[56] References Cited

U.S. PATENT DOCUMENTS 3,650,706 3/1972 Parsons .
4,054,354 10/1977 Unger .
4,492,023 1/1985 Schneider et al. ..... 29/857 X
4,767,353 8/1988 Hughes et al. ..... 439/937 X
5,174,022 12/1992 Phillips et al. .

FOREIGN PATENT DOCUMENTS 6-36817 2/1994 Japan .

*Primary Examiner*—Carl J. Arbes
*Attorney, Agent, or Firm*—Sughrue, Mion, Zinn, Macpeak & Seas, PLLC

[57] ABSTRACT

A method of producing a press-connecting joint connector and a method of press-connecting wires, in which the step of mounting press-connecting terminals in a housing is eliminated thereby reducing the production time, the housing-forming mold is simplified, and connective portions are prevented from being easily ruptured. Linked press-connecting terminal groups (32) are inserted-molded integrally in housings (34), respectively, thereby forming press-connecting joint connectors (30) which are linked together by a linkage plate (40) which is integral with the press-connecting terminal groups (32). Thus, when molding the housings (34), the press-connecting terminal groups (32) are formed integrally with the housings (34), respectively, so that the step of inserting the press-connecting terminal groups into the respective housings (34) is eliminated. The housings (34) can be molded independently of each other so that the housing (34) can be simplified, and linkage portions of the press-connecting joint connectors (30) have an increased strength.

4 Claims, 5 Drawing Sheets

METHOD OF PRODUCING A PLURALITY OF PRESS-CONNECTING JOINT CONNECTORS

BACKGROUND OF THE INVENTION

1. Field of the Invention

This invention relates to a method of producing a press-connecting joint connector and a method of press-connecting wires, and more particularly to a method of producing a press-connecting joint connector for electrically connecting a plurality of wires or electric devices together and a method of press-connecting such wires. Additionally, the invention relates to the press-connecting joint connector itself.

2. Related Art

A conventional press-connecting joint connector for electrically connecting a plurality of wires or electric devices together is disclosed in Japanese Utility Model Unexamined Publication No. 1-137091 and illustrated in FIGS. 9 and 10. As shown in FIG. 9, in this press-connecting joint connector 10, a plurality of connection sections 14 are formed in a housing 12, and a press-connecting terminal 16 is mounted in each of the connection sections 14.

As shown in FIG. 10, for producing the press-connecting joint connectors 10, the housings 12 are first molded by a continuous molding apparatus 18. At this time, the housings 12 are molded integrally with one another into a band-like configuration, and are interconnected or linked by connective portions 20 (see FIG. 9). Then, the press-connecting terminals 16 are inserted respectively into the connection sections 14 in the housing 12 by a press-connecting terminal insertion apparatus 22, thereby producing the press-connecting joint connector 10. Thereafter, the press-connecting joint connectors 10 linked by the connective portions 20 wound around reel 24.

Subsequently, a chain of press-connecting joint connectors taken up by the reel 24 is transferred to a wire press-connecting step, whereupon wires are press-fitted into the press-connecting terminals 16, respectively. As a result, a sheath of each wire is cut by a press-connecting blade of the associated press-connecting terminal 16 such that a conductor of the wire contacts the press-connecting terminal 16, so that the wires are electrically interconnected. Finally, the connective portions 20 are severed to thereby separate the press-connecting joint connectors 10 from one another.

However, in the production of the conventional press-connecting joint connector 10, there is required the step of inserting the press-connecting terminals 16 respectively into the plurality of connection sections 14 in the housing 12, and this step increases the production time, which leads to an increase in cost.

Additionally, since the housings 12 of the press-connecting joint connectors 10 are molded integrally with one another into a band-like configuration, a housing-forming mold is large in size, and complicated, which also leads to an increase in cost.

Furthermore, the connective portions 20 formed integrally with the housings 12, are made of a resin, and therefore can be easily cut. Therefore, when feeding the housing 12 or the press-connecting joint connector 10, this feeding operation can not be effected properly, so that the connective portion 20 is ruptured.

SUMMARY OF THE INVENTION

With the above problems in view, it is an object of this invention to provide a method of producing a press-connecting joint connector and a method of press-connecting wires, in which the step of mounting press-connecting terminals in a housing is eliminated, thereby reducing the production time. Additionally, the housing-forming mold is simplified, and connective portions are prevented from being easily ruptured.

The above objects have been achieved by a method of producing a press-connecting joint connector having a plurality of press-connecting terminals provided in a housing; characterized in that press-connecting terminal groups, each comprising the plurality of press-connecting terminals, are integrally molded in the housings, respectively, thereby forming the plurality of press-connecting joint connectors linked together.

The above object can be achieved by a method in which the press-connecting joint connectors are produced by insert-molding the press-connecting terminal groups, linked together by a linkage plate, using a non-conductive material.

The above object can be achieved by a method of press-connecting wires to a press-connecting joint connector having a plurality of press-connecting terminals provided in a housing; characterized in that a plurality of press-connecting terminal groups, each comprising the plurality of press-connecting terminals, are linked together; the linked press-connecting terminal groups are integrally molded in the housings, respectively, thereby forming the linked press-connecting joint connectors; after the linked press-connecting joint connectors are separated, by cutting, from one another, the plurality of wires are press-connected to the press-connecting terminal group of the press-connecting joint connector; and subsequently a cover is attached to the connector.

The above object can be achieved by a method in which the press-connecting joint connectors, wound on a reel, are supplied from the reel, and are separated, by cutting, from one another before the wires are press-connected.

The above object can be achieved by a method in which the press-connecting joint connectors are separated, by cutting, from one another at respective connective portions of the press-connecting terminal groups which are covered with a non-conductive material.

In the press-connecting joint connector-producing method according to the present invention, the press-connecting terminal groups, each comprising the plurality of press-connecting terminals, are integrally molded in the housings, respectively, thereby producing the plurality of press-connecting joint connectors connected together in a linked manner.

Thus, in the molding of the housing, the press-connecting terminal group is integrally molded in the housing, and therefore the step of inserting the press-connecting terminals into the housing is eliminated.

The press-connecting terminal groups linked together by the linkage plate are insert-molded in the respective press-connecting joint connectors, using the non-conductive material. Therefore, instead of being molded in a linked manner, the housings can be molded independently of one another, and the housing can be simplified in construction. Therefore, a housing-forming mold can be simplified, so that the cost is reduced. Since the linkage plate is made of the conductive metal material of which the press-connecting terminals are also made, the linkage plate has an increased strength, and will not be easily ruptured. Therefore, even when the linked press-connecting joint connectors are not fed properly, the linkage plate will not be ruptured.

In the wire press-connecting method of the present invention, the plurality of press-connecting terminal groups, each comprising the plurality of press-connecting terminals, are linked together, and the linked press-connecting terminal groups are integrally connected respectively to the housings by molding, thereby providing the linked press-connecting joint connectors. After the linked press-connecting joint connectors are separated from each other by cutting, the plurality of wires are press-connected to the press-connecting terminal group of the press-connecting joint connector, and then the cover is fitted on the housing.

With this construction, when press-fitting the wires into the press-connecting joint connector, plastic deformation of the press-connecting terminals is prevented, and the wires are positively press-connected to the respective press-connecting terminals, and a highly-reliable automatic press-connecting process is achieved.

Furthermore, the press-connecting joint connectors once wound on the reel are supplied from the reel, and are separated from each other by cutting before the wires are press-connected. With this arrangement, the linked press-connecting joint connectors can be stored in a more compact manner, and can be positively supplied to the wire press-connecting step.

The press-connecting joint connectors are separated by cutting from each other at the respective connective portions each of which is connected to the press-connecting terminal group, and is covered with the non-conductive material. The cut portion of the connective portion is kept covered with the non-conductive material, thus preventing the metal portion from being exposed.

DETAILED DESCRIPTION OF THE INVENTION

Figure 1:
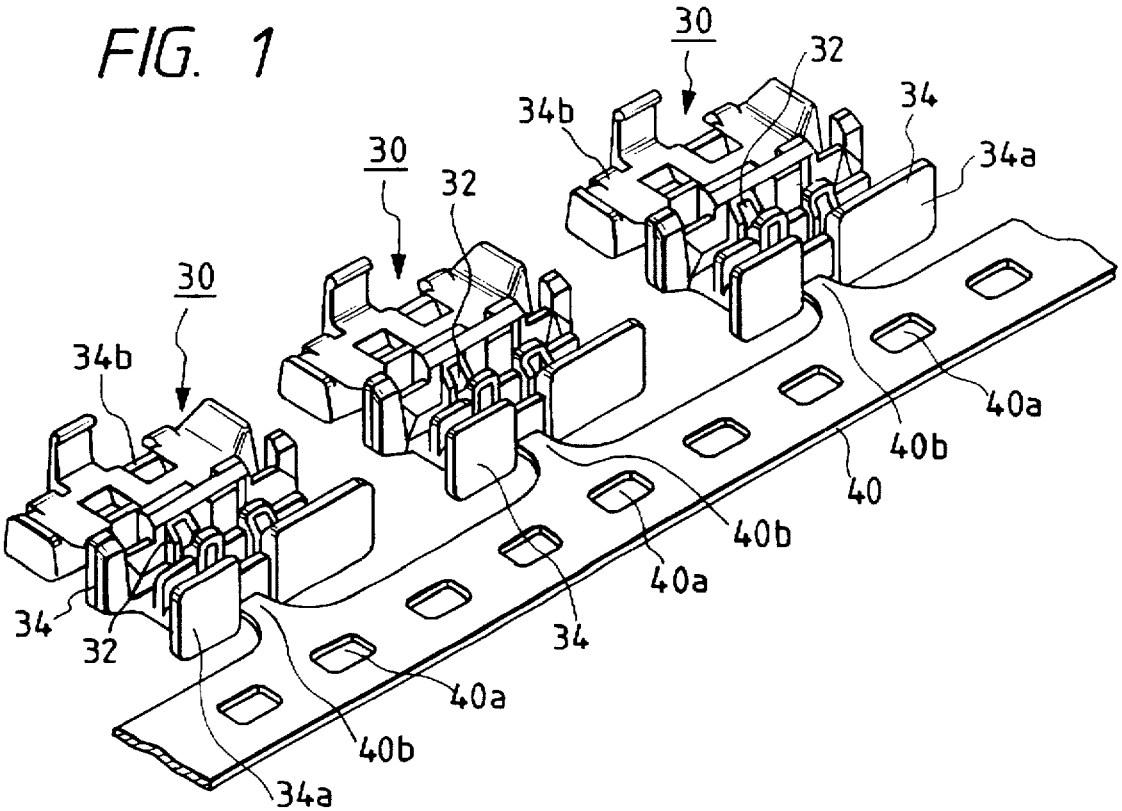
FIG. 1 is a perspective view of linked press-connecting joint connectors in a press-connecting joint connector-producing method of the invention.
Figure 3:
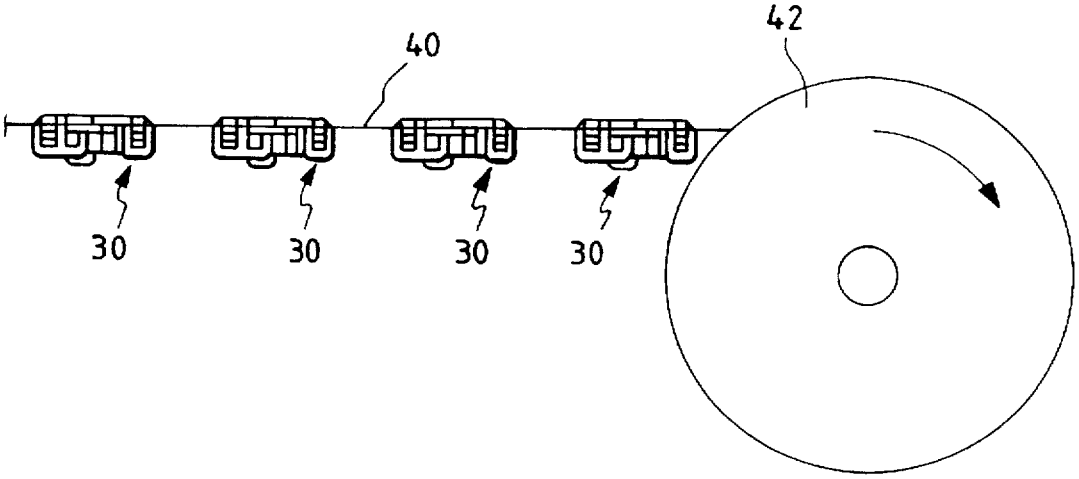
FIG. 3 is a side-elevational view showing a condition in which the linked press-connecting joint connectors of FIG. 1 is taken up by a reel.
Figure 4:
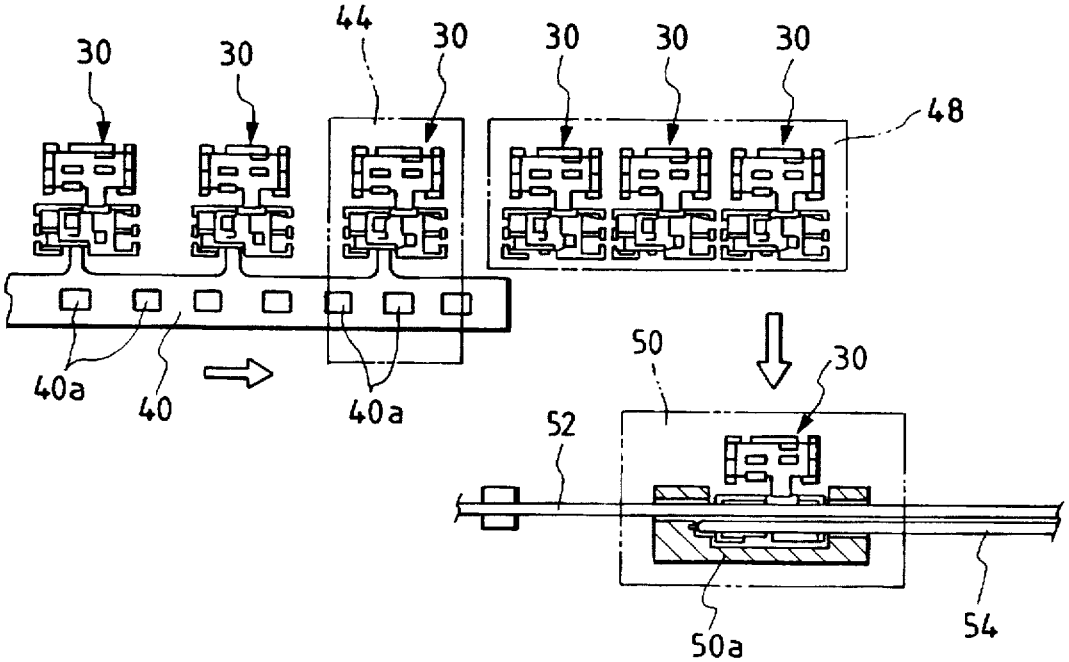
FIG. 4 is a plan view showing a wire press-connecting method of the invention.
Figure 5:
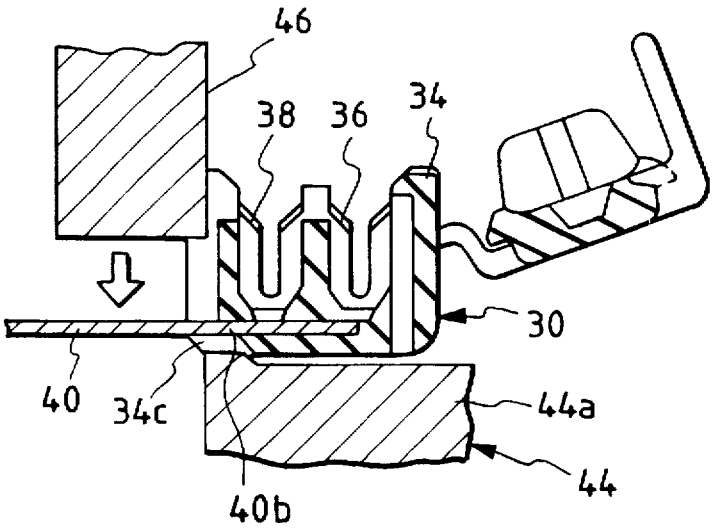
FIG. 5 is a cross-sectional view showing the manner of removing the press-connecting joint connector.
Figure 6:
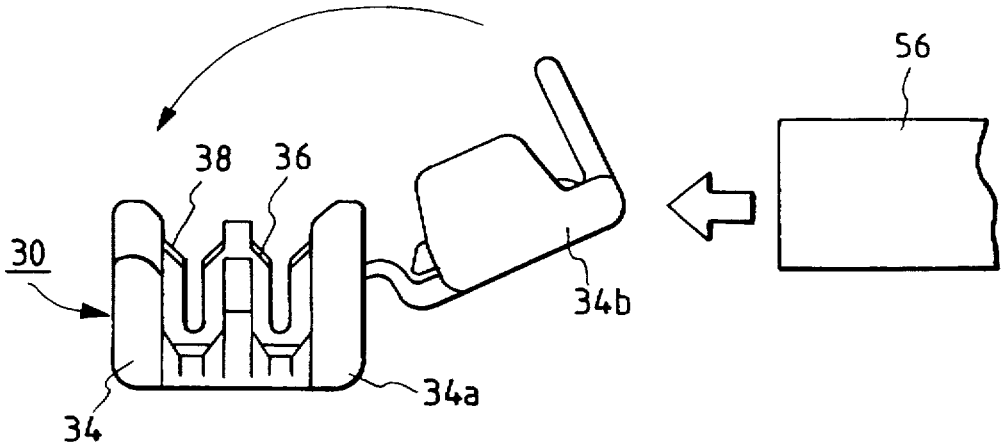
FIG. 6 is a side view showing the step of attaching a cover in the method of FIG. 4.

A method of producing a press-connecting joint connector according to the invention, as well as a method of press-connecting wires, will now be described in detail with reference to FIGS. 1 to 6. FIG. 1 is a perspective view linked press-connecting joint connectors in the press-connecting joint connector-producing method of the invention, FIG. 2 is a perspective view of linked groups of press-connecting terminals, FIG. 3 is a side-elevational view showing a condition in which the linked press-connecting joint connectors of FIG. 1 is taken up by a reel, FIG. 4 is a plan view showing the wire press-connecting method of the invention, FIG. 5 is a cross-sectional view showing the manner of removing the press-connecting joint connector, and FIG. 6 is a view showing the step of attaching a cover in the method of FIG. 4.

Figure 2:
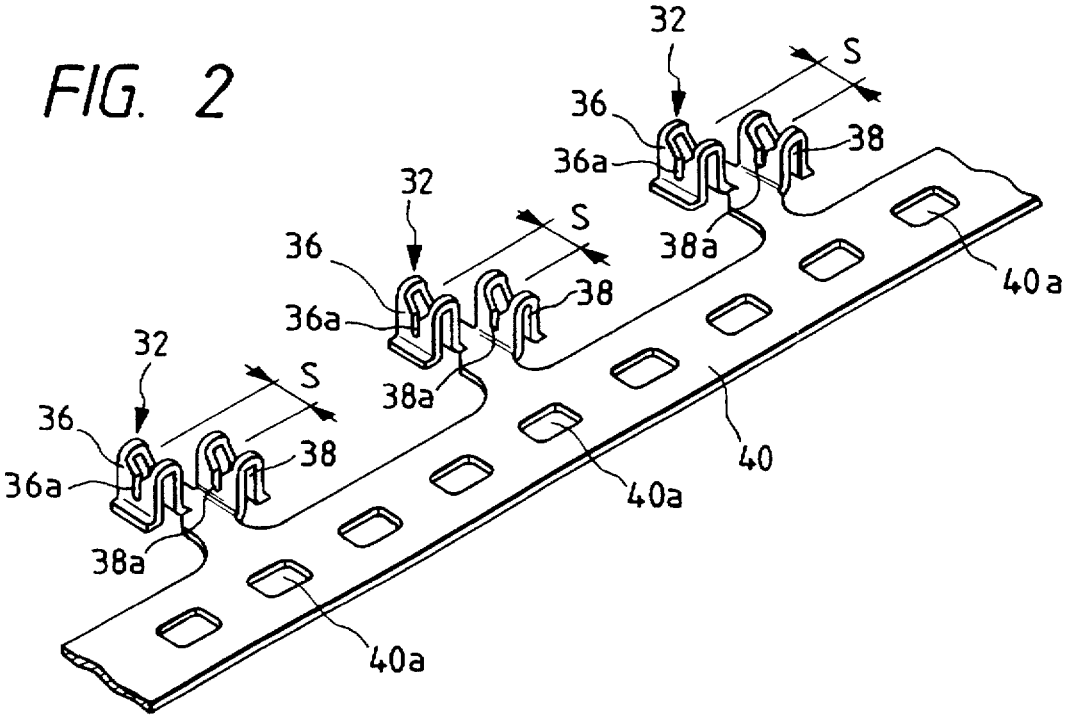
FIG. 2 is a perspective view of linked groups of press-connecting terminals.

As shown in FIGS. 1 and 2, each of the press-connecting joint connectors 30 comprises a group 32 of press-connecting terminals provided in a housing 34. Adjacent groups 32 of press-connecting terminals are connected through respective connective portions **40*b* to a linkage plate 40 in a linked manner, and are spaced at predetermined intervals. Each of the press-connecting terminal groups 32 comprises two press-connecting terminals 36 and 38, shown in FIG. 2. The distance S between wire fitting grooves 36*a* and 38*a* formed respectively in the press-connecting terminals 36 and 38 determines the pitch of two wires press-connected respectively to these wire fitting grooves 36*a* and 38*a***.

The linkage plate 40 has a band-like configuration, and feed holes **40*a* are formed in the linkage plate 40 at predetermined intervals. In a molding step for molding the press-connecting joint connectors 30, the press-connecting terminal groups 32 are sequentially fed into a housing-molding apparatus (not shown) through the feed holes 40*a***.

The press-connecting terminal groups 32 fed into the housing-molding apparatus are inserted-molded integrally in the molded housings 34, respectively, the housings 34 being molded of a non-conductive synthetic resin. As a result, the press-connecting joint connectors 30 are connected to the linkage plate 40 in a linked manner.

As shown in FIG. 1, each housing 34 comprises a connector body **34*a*, and a cover 34*b* which is connected to the connector body 34*a* through an elastic hinge. Therefore, by bending this hinge, the cover 34*b* can be attached to the connector body 34*a***.

As shown in FIG. 3, the press-connecting joint connectors 30, connected to the linkage plate 40 in a linked manner, are taken up by the reel 42.

Then, the linked press-connecting joint connectors 30 thus taken up by the reel 42 are transferred, together with the reel 42, to a wire press-connecting step, and are set on a supply apparatus (not shown).

Thereafter, the linked press-connecting joint connectors 30 set on the supply apparatus are supplied from the reel 42 utilizing the feed holes **40*a* in the linkage plate 40. As a result, the press-connecting joint connectors 30 are sequentially fed to a cutting apparatus 44**, shown in FIG. 4.

It is noted that the linkage plate 40 is made of the same electrically-conductive metal material as the groups 32 of press-connecting terminals are made. Therefore, the linkage plate 40 will not be easily ruptured during the feeding operation.

The press-connecting joint connectors 30 are thus fed sequentially to a support base **44*a* of the cutting apparatus 44, and are sequentially removed from the linkage plate 40 by a downwardly-moving cutting blade 46 of the cutting apparatus 40**, as shown in FIG. 5.

A bottom portion **34*c* of the housing 34 close to the linkage plate 40 is recessed, so that the connective portion 40*b* of the linkage plate 40 is exposed from the housing 34. Therefore, when the press-connecting joint connector 30 is set on the support base 44***a* of the cutting apparatus 44, the connective portion 40*b* is held in contact with the surface of the support base 44*a*. In this condition, the connective portion 40*b* is positively severed by the cutting blade 46. Thus, the connective portion 40*b* is severed while being held in contact with the surface of the support base 44*a*, and therefore burrs are prevented from forming at the cut portion of the connective portion 40*b*, thus preventing such burrs from projecting downwardly from the bottom surface of the housing 34.

Subsequently, the press-connecting joint connectors 30, having been removed from the linkage plate 40, are fed to a storage portion 48 where they are stored, as shown in FIG. 4. Thereafter, the standby press-connecting joint connectors 30 are sequentially fed to a positioning portion 50*a* of a press-connecting apparatus 50, and a wire 52 (main wire) and a wire 54 (auxiliary wire) are set respectively on press-connecting positions for the press-connecting joint connector 30.

More specifically, as shown in FIGS. 2 and 4, the wire 52 is located above the wire fitting groove 36*a* in the press-connecting terminal 36, and the other wire 54 is located above the wire fitting groove 38*a* in the press-connecting terminal 38.

In this condition, the press-connecting apparatus 50 is operated to press-connect or press-fit the wires 52 and 54 respectively into the wire fitting grooves 36*a* and 38*a* formed respectively in the press-connecting terminals 36 and 38. As a result, the sheaths of the wires 52 and 54 are cut by the press-connecting terminals 36 and 38, respectively, so that the respective conductors are brought into contact with the press-connecting terminals 36 and 38, respectively. As a result, the two wires 52 and 54 are electrically connected together through the press-connecting terminal group 32.

Finally, a jig 56 of the press-connecting apparatus 50 is operated to push the cover 34*b* of the housing 34, thereby fitting the cover 34*b* on the connector body 34*a*, as shown in FIG. 6. As a result, a lock portion (not shown) of the cover 34*b* is retainingly engaged with a lock portion (not shown) of the connector body 34*a*, so that the cover 34*b* is retained on the connector body 34*a*.

Thus, those portions of the wires where their conductors are exposed are covered by the cover 34*b*, and also the two wires are fixed by the press-connecting joint connector 30, thus completing the wire press-connecting operation.

Figure 7:
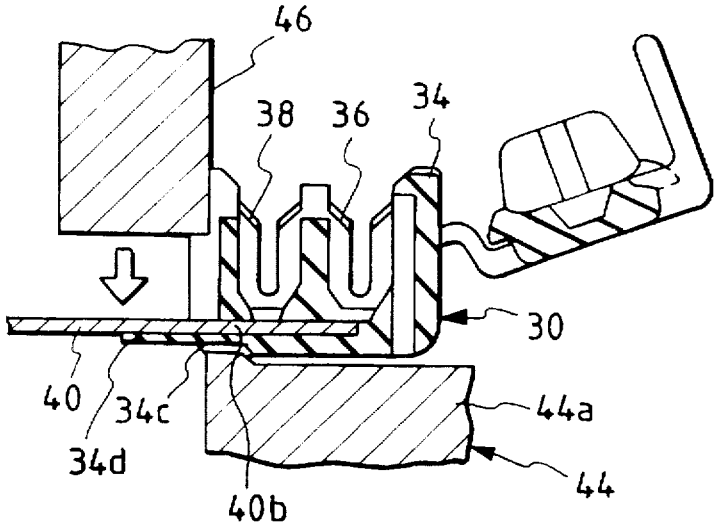
FIG. 7 is a cross-sectional view showing the manner of removing a modified press-connecting joint connector in the wire press-connecting method of the invention.
Figure 8:
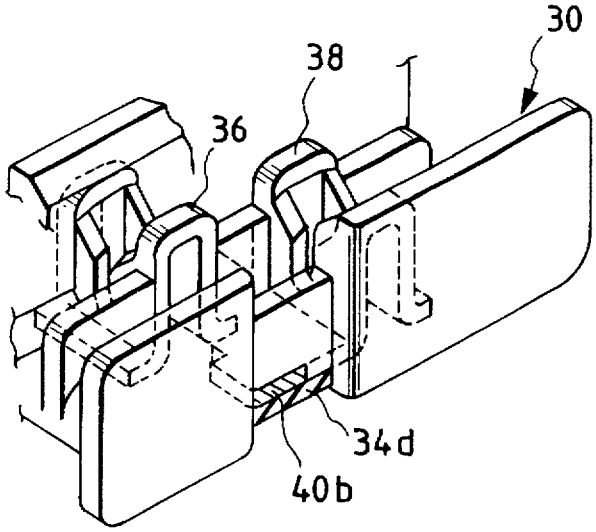
FIG. 8 is a perspective view of an important portion of the modified press-connecting joint connector of FIG. 7.
Figure 9:
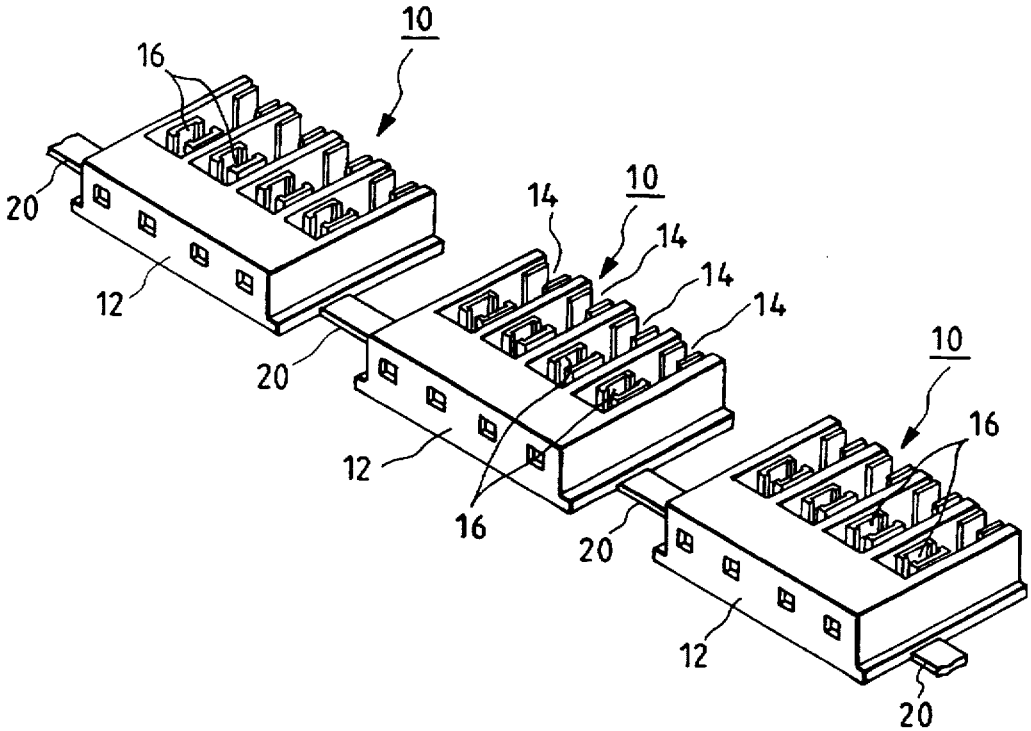
PRIOR ART FIG. 9
FIG. 9 is a perspective view of conventional press-connecting joint connectors.
Figure 10:
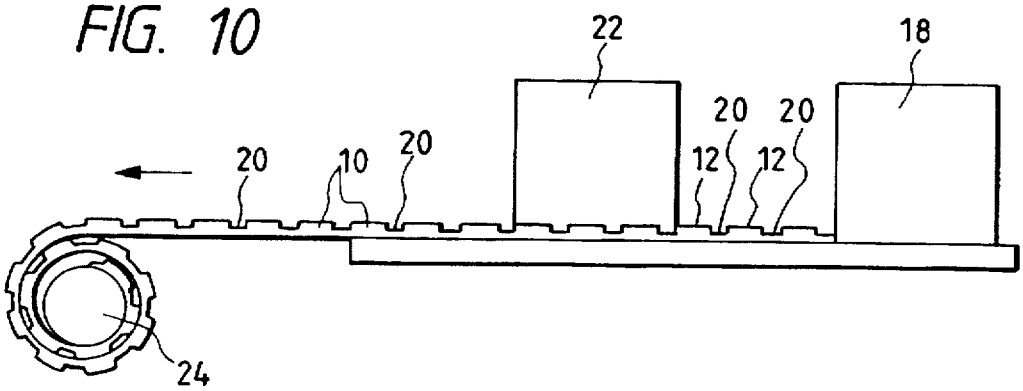
PRIOR ART FIG. 10
FIG. 10 is a view showing a condition in which the press-connecting joint connectors of FIG. 9 is taken up by a reel.

In the above embodiment, although the connective portion 40*b* of the linkage plate 40 is exposed at the bottom portion 34*c* of the housing 34, the invention is not limited to such an arrangement. For example, in the molding of the housing 34, a covering portion 34*d* of a non-conductive synthetic resin may be molded integrally on the bottom surface of the connective portion 40*b* of the linkage plate 40, as shown in FIG. 7. This covering portion 34*b* has such a thickness that it can be cut by the cutting blade 46. Therefore, the covering portion 34*d* is cut or severed simultaneously to when the connective portion 40*b* is severed by the cutting blade 46, as shown in FIG. 8.

Thus, the covering portion 34*d* is formed on the bottom surface of the connective portion 40*b* exposed through the bottom portion 34*c* of the housing 34. The cut surface of the connective portion 40*b* is covered by the cover 34*b*. Therefore, the connective portion 40*b*, exposed through the bottom portion 34*c* of the housing 34, is completely covered, thus preventing the metal portion from being exposed. Therefore, when the connector is mounted on a vehicle, short-circuiting due to contact with the vehicle body is prevented.

Even if burrs are formed on the cut portion of the connective portion 40*b* of the linkage plate 40, these burrs are covered with the cover 34*b*, and therefore short-circuiting is prevented.

As described above, in the press-connecting joint connector-producing method and the wire press-connecting method according to the invention, the press-connecting terminal groups, each comprising the plurality of press-connecting terminals, are integrally molded in the housings, respectively, thereby producing the plurality of press-connecting joint connectors connected together in a linked manner.

Thus, in the molding of the housing, the press-connecting terminal group is integrally molded in the housing, and therefore the step of inserting the press-connecting terminals into the housing is eliminated. Therefore, the time required for producing the press-connecting joint connector can be reduced, and the production efficiency is enhanced, so that the cost can be reduced.

The press-connecting terminal groups linked together by the linkage plate are insert-molded in the respective press-connecting joint connectors, using the non conductive material.

Therefore, instead of the housings being molded in a linked manner, they are molded independently of one another, and the housing can be simplified in construction. Therefore, a housing-forming mold can be simplified, so that the cost is reduced.

Since the linkage plate is made of the conductive metal material of which the press-connecting terminals are also made, the linkage plate has an increased strength, and will not be easily ruptured. Therefore, even when the linked press-connecting joint connectors are not fed properly, the linkage plate will not be ruptured.

The plurality of press-connecting terminal groups each comprising the plurality of press-connecting terminals are linked together, and the linked press-connecting terminal groups are integrally connected respectively to the housings by molding, thereby providing the linked press-connecting joint connectors. After the linked press-connecting joint connectors are separated from each other by cutting, the plurality of wires are press-connected to the press-connecting terminal group of the press-connecting joint connector, and then the cover is fitted on the housing.

With this construction, when press-fitting the wires into the press-connecting joint connector, plastic deformation of the press-connecting terminals is prevented, and the wires are positively press-connected to the respective press-connecting terminals, and the highly-reliable automatic press-connecting process is achieved. Therefore, the efficiency of connection of the wires to the press-connecting joint connector is enhanced.

Furthermore, the press-connecting joint connectors once wound on the reel are supplied from the reel, and are separated from each other by cutting before the wires are press-connected. With this arrangement, the linked press-connecting joint connectors can be stored in a more compact manner, and can be positively supplied to the wire press-connecting step.

Therefore, the linked press-connecting joint connectors can be handled easily and properly when supplying them to the press-connecting step, so that the production efficiency is markedly enhanced.

The press-connecting joint connectors are separated by cutting from each other at the respective connective portions each of which is connected to the press-connecting terminal group, and is covered with the non-conductive material. The cut portion of the connective portion is maintained covered with the non-conductive material, thus preventing the metal portion from being exposed.

With this construction, when the connector is mounted on a vehicle, short-circuiting due to contact with a vehicle body is prevented.

We claim:

1. A method of producing a plurality of press-connecting joint connectors, comprising the following steps:

providing a plurality of press-connecting terminal groups which are connected to each other via a linkage plate, each one of said groups including a plurality of press-connecting terminals;

integrally molding said each one of said groups in a housing thereby forming a plurality of press-connecting joint connectors interconnected via said linkage plate.

2. The method of claim 1, wherein said providing step comprises the step of providing a plurality of said terminal groups which are made out of an electrically conductive metal.

3. The method of claim 2, wherein said providing step comprised the step of providing said linkage plate which is made out of said electrically conductive metal.

4. The method of claim 1, wherein said housing includes a base portion and a cover portion for covering said press-connecting terminals.

* * * * *